United States Patent [19]

Hobrough

[11] Patent Number: 4,580,014

[45] Date of Patent: Apr. 1, 1986

[54] MEANS FOR CONTROLLING RIBBON EDGE CLEARANCE IN A RIBBON LOUDSPEAKER

[76] Inventor: Theodore B. Hobrough, 1300 Richards St., Vancouver, British Columbia, Canada, V6B 3G6

[21] Appl. No.: 506,429

[22] Filed: Jun. 21, 1983

[51] Int. Cl.[4] ..... H04R 7/16; H04R 9/00

[52] U.S. Cl. ..... 179/115 V; 179/115.5 PV

[58] Field of Search ..... 179/115 V, 115.5 PV, 179/115 R, 115.5 R; 29/594

[56] References Cited

U.S. PATENT DOCUMENTS 3,564,163 2/1971 Hobrough ..... 179/115 V

FOREIGN PATENT DOCUMENTS 55-25231 2/1980 Japan ..... 179/115 V

*Primary Examiner*—Gene Z. Rubinson

*Assistant Examiner*—Danita R. Byrd

*Attorney, Agent, or Firm*—Knobbe, Martens, Olson & Bear

[57] ABSTRACT

A ribbon assembly and a method of forming same for use in a ribbon loudspeaker which has an elongated electrically conducting ribbon, a magnet means for producing a magnetic field parallel to a mean plane through and directed transversely to the ribbon, and means for generating a varying electrical current through the ribbon. The ribbon assembly includes a wafer board having an elongated aperture and means for mounting the ribbon across the aperture, to electrically conducting pads at either end thereof such that the clearance between the elongated edges of the ribbon and the adjacent elongated ribbon facing edge of the aperture, are less than 1% of the ribbon width. A pair of elongated side rails are removably disposed along each elongated side of the aperture to form ribbon facing edges of the aperture.

4 Claims, 5 Drawing Figures

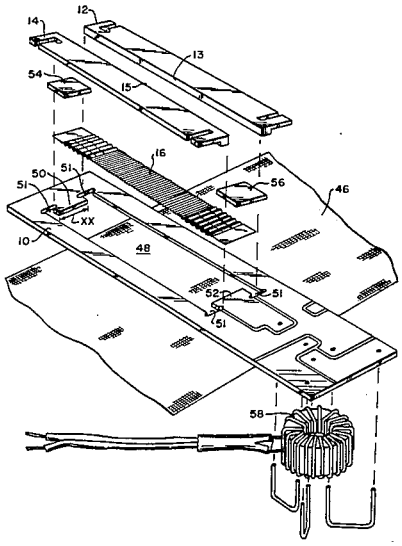

MEANS FOR CONTROLLING RIBBON EDGE CLEARANCE IN A RIBBON LOUDSPEAKER

The present invention relates to a ribbon assembly for a ribbon loudspeaker consisting of a ribbon of metal foil mounted in a transverse magnetic field parallel to the surface of the foil and caused to vibrate in response to the electromagnetic forces induced by a varying electrical current from an amplifier passing along the length of the foil. The nature of such devices is set forth in U.S. Pat. No. 3,564,163 issued to Gilbert L. Hobrough.

One of the factors that has limited ribbon loudspeaker performance is air flow leakage through the clearance between the longitudinally extending edges of the ribbon and pole faces establishing the magnetic field. As the ribbon moves in response to electromagnetic forces in the course of its vibrations perpendicular to the plane defined by its surface, air leaks past the edges of the ribbon in response to the pressure difference set up by the forces on the ribbon. If the leakage flow were a linear function of the pressure difference across the edges of the ribbon, the effect of such leakage would merely be to linearly increase the amplitude of ribbon vibration. However, the airflow changes suddenly from laminar to turbulent flow at a relatively low but ill-defined pressure difference. Both turbulent flow, and the transition are highly nonlinear with respect to pressure, and result in nonlinear distortion of the ribbon vibration amplitude which is particularly strong at the low end of a ribbon speaker's frequency range. In practice, a clearance of about 1.0% of ribbon width or 5 mils for a ½ inch wide ribbon gives rise to approximately 10 to 15% third harmonic distortion whereas a clearance of about 0.1% yields 0.1 to 0.2% distortion.

Previously the maintenance of a clearance of the order of 1–3 mils between the ribbon and the pole pieces without restricting the amplitude of vibration was impractical.

The difficulty in establishing and controlling such a small clearance over the entire length of a long flexible ribbon arises because of such factors as twisting and bending and stretching of the ribbon through overheating, uneven ribbon edges, movement of the ribbon ends during clamping and the difficulty in machining and lining up the opposed pole pieces to such close tolerances.

SUMMARY OF THE INVENTION

According to the invention there is provided a ribbon assembly for a ribbon loudspeaker having elongated electrically conducting ribbon, a magnet means for producing a magnetic field parallel to a mean plane through but transverse to the ribbon, and means for generating a varying electrical current through the ribbon. The ribbon assembly includes a wafer board having an elongated aperture and a means for mounting the ribbon across the aperture to electrically conducting pads at either end thereof such that the clearance between the elongated edges of the ribbon and adjacent elongated ribbon facing edges of the aperture are less than 1.0% of the average ribbon width.

Preferably the wafer board includes a pair of elongated side rails one positioned along each elongated side of the aperture forming elongated ribbon facing edges thereof. The rails may advantageously be magnetically permeable.

The wafer board may be a printed circuit board laminate with etched metal conducting surfaces to provide electrically conducting paths thereon.

Utilizing a wafer board on which to mount the ribbon allows accurate control over the clearance between the ribbon edges and the pole pieces or side rails thereby minimizing non linear distortion of the ribbon vibration amplitude. It also facilitates repair of the loudspeaker for a failed ribbon by simply replacing the wafer board assembly having the failed ribbon by another board assembly. In another aspect of the invention there is provided a method of forming a ribbon assembly for use in a ribbon loudspeaker which includes forming a planar wafer board having an elongated aperture, electrically conducting pads at either end of said aperture and current conducting paths to said pads. By affixing each end of an electrically conducting elongated ribbon to a corresponding pad at an end of the aperture and ablating the elongated edges of the ribbon to a predetermined width and position relative to the board, clearances between the ribbon and the aperture edges of less than 1.0% of the average ribbon width are routinely achieved.

The ribbon facing aperture edges may be formed by installing elongated rails along either elongated side of an elongated opening in the board such that opposed surfaces of the rails define the ribbon facing aperture edges.

Trimming of the ribbon edges may be done by positioning an elongated electrode parallel and adjacent to each ribbon edge, applying a high negative voltage to the electrode relative to the ribbon and moving the electrode towards the ribbon edge such that a discharge is formed between the ribbon edge and the electrode which vapourizes or otherwise ablates the ribbon edge. By utilizing a precision machined straight carbon electrode movable toward the ribbon at a controlled predetermined rate, the resulting ablated ribbon edge conforms accurately to the position of the carbon electrode adjacent the ribbon.

The ends of the ribbon may be affixed to their corresponding pads by ultrasonic welding or soldering.

BRIEF DESCRIPTION OF THE DRAWINGS

In drawings which illustrate a preferred embodiment of the invention.

DETAILED DESCRIPTION WITH REFERENCE TO THE DRAWINGS

Figure 1:
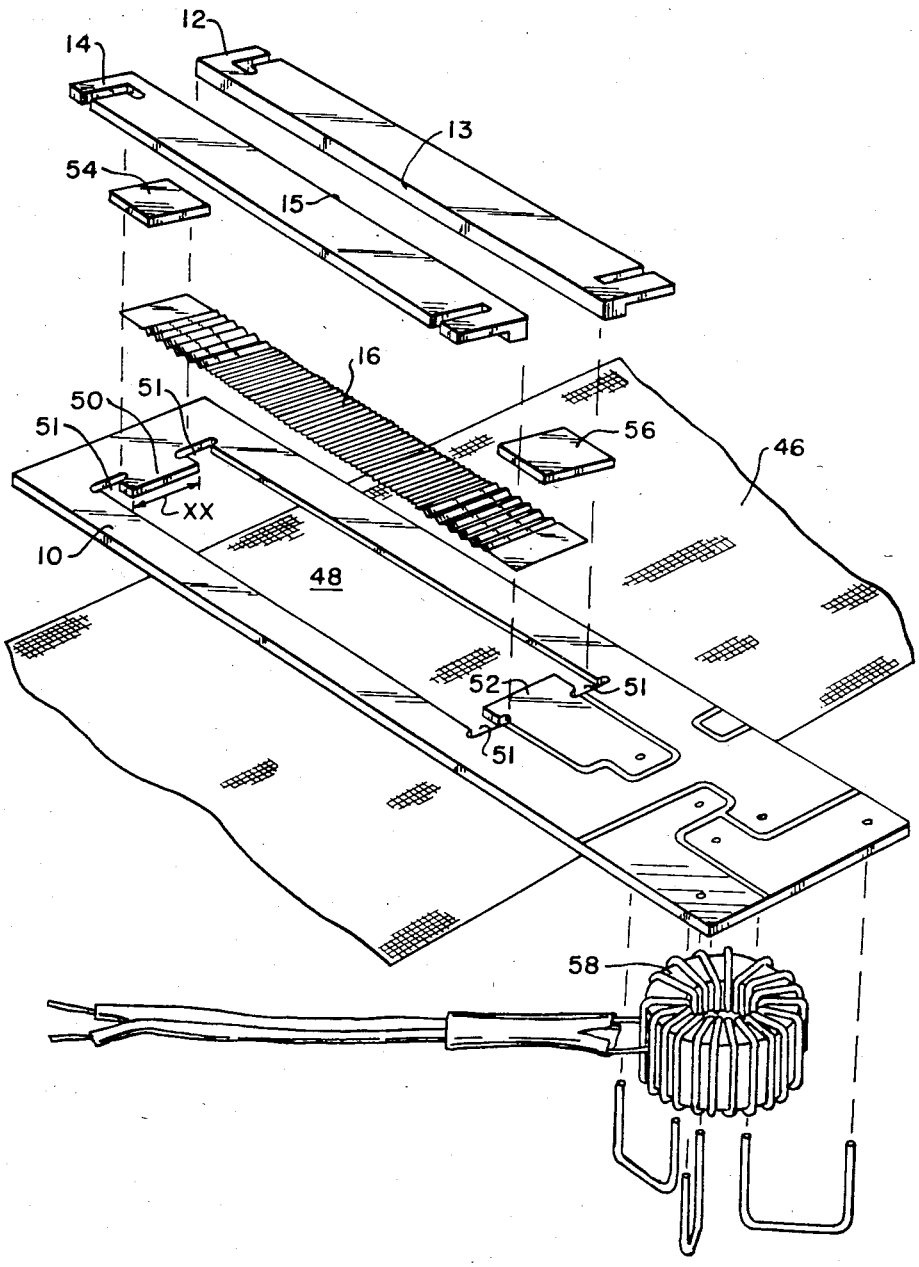
FIG. 1 is an exploded view of the wafer board assembly.

Shown in FIG. 1 is a ribbon assembly in exploded form for a ribbon loudspeaker which includes a wafer board 10 fabricated from a printed circuit board laminate. The board 10 has a large elongated rectangular opening 48 with slotted out portions 51 at each corner of opening 48. Mounting pads 50 and 52 are located at either end of opening 48. A pair of ears are formed on the sides of each pad 50 and 52 which project into associated slotted out portions 51. The board 10 is etched to provide electrically isolated pads 50 and 52 as well as pads for mounting a toroidal transformer 58 by means of its secondary windings.

Ultrasonically welded to pads 50 and 52 is a ribbon 16 of aluminum foil. Ribbon 16 is corrugated with relatively small radius bends having a radius of approximately ¼ mm except for a length of about 1 cm at either end which is corrugated with bends having a radius of approximately 3 mm. The corrugations serve to enhance flexibility of the ribbon. Aluminum is a preferred material for the ribbon because of its relatively low resistivity and low density as compared to other electrical conductors. The ribbon 16 is stretched to a predetermined extent during the welding to eliminate sag.

Figure 2:
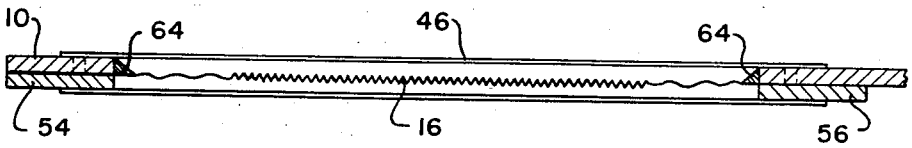
FIG. 2 is a side elevation view in section of the wafer board assembly along line 2—2 in FIG. 5.

Proximate the points of attachment of the ribbon 16 to the board 10 there is placed a viscous resilient damping compound 64 as seen in FIG. 2. The compound 64 serves to reduce the reflection of ribbon displacement waves from the rigidly affixed ends of the ribbon 16.

On either side of the opening 48 there is mounted a narrow 12 and a wide 14 side rail having opposed ribbon facing edges 13 and 15, respectively and outer edges of 11 and 19, respectively. The rails 12 and 14 each abut against corresponding ears of pads 50 and 52 to form a working aperture having width XX as shown in FIG. 1. The clearance between the ribbon edges and the rail edges 13 and 15, is less than 1.0% of the ribbon width. A ribbon width of about ¾ inches or 1.9 cm has been used successfully.

Figure 3:
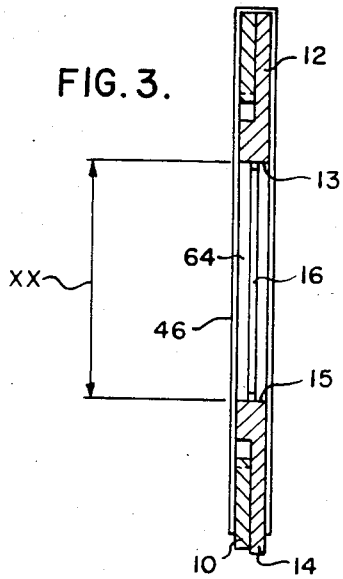
FIG. 3 is an end elevation view in section along line 3—3 of FIG. 5.

As shown in FIG. 3 each side rail 12 and 14 has an elongated thickened inner edges 13 and 15, respectively equal in thickness to the combined thicknesses of the outer edges 11 and 19 of respective rails 12 and 14 and the board 10.

Accoustical seals 54 and 56 are mounted over respective welded ends of ribbon 16 completely filling the space between edges 13 and 15 of rails 12 and 14, respectively, and equal in thickness to the outside edges 11 and 19 of the rails 12 and 14.

A silk screen 46 covers each face of the assembly of board 10, rails 12 and 14 and ribbon 16 from a point proximate the wide rail 14 with the screen extending around the short rail 12 so that the width from each side of the assembly to the centre thereof is the same. The screen not only protects ribbon 16 from damage during handling but also acts to suppress low frequency standing waves set up in the ribbon below about 500 Hertz.

Figure 4:
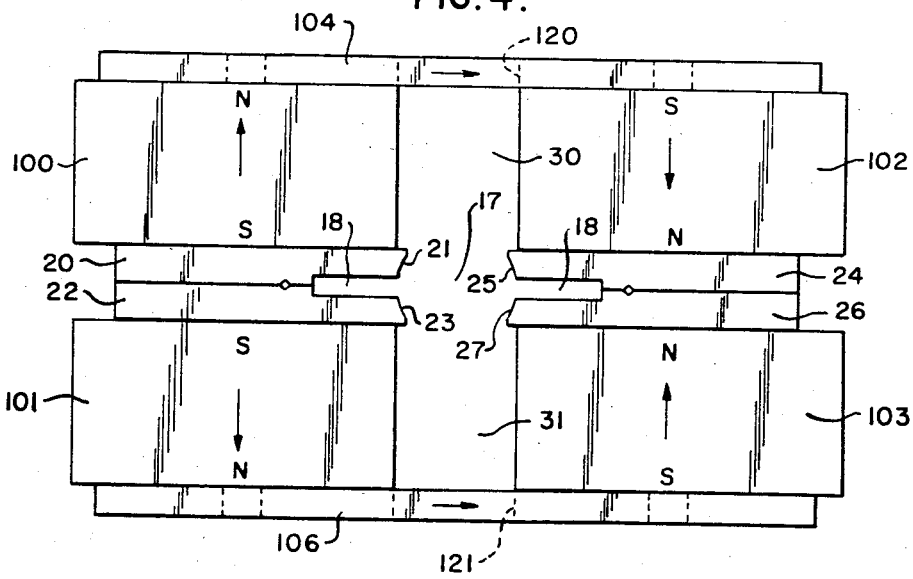
FIG. 4 is an elevation view of the magnet assembly.

FIG. 4 illustrates a magnet assembly for use in conjunction with the ribbon assembly of FIG. 1. The magnet assembly includes 4 magnets 100, 101, 102, and 103 aligned such that the south poles of magnets 100 and 101 are opposite each other and the north poles of magnets 102 and 103 are opposite each other. Bonded to magnets 100 and 101 and to each other are pole pieces 20 and 22. Similarly pole pieces 24 and 26 are bonded to each other and to magnets 102 and 103. The pole pieces 20, 22 and 24, 26 are shaped so as to form opposed slotted tracks 18.

Pole pieces 20, 22, 24 and 26 have curved elongated inner edges 21, 23, 25 and 27, respectively, such that the separation between opposed edges 21 and 25, and 23 and 27 decreases in a direction away from slotted tracks 18. The foregoing separation compensates for the tendency of the magnetic field lines in gap 17 to spread apart and thus reduce the magnetic field intensity in the central region thereof.

Magnetically permeable return plates 104 and 106 disposed above and below permanent magnets 100 and 102, and 101 and 103, respectively, provide a return path for the magnetic field across gap 17. Each plate 104 and 106 has a rectangular aperture 120, and 121, respectively, substantially coextensive with the spaces 30 and 31 between the magnets 100 and 102 and 101 and 103, respectively.

Figure 5:
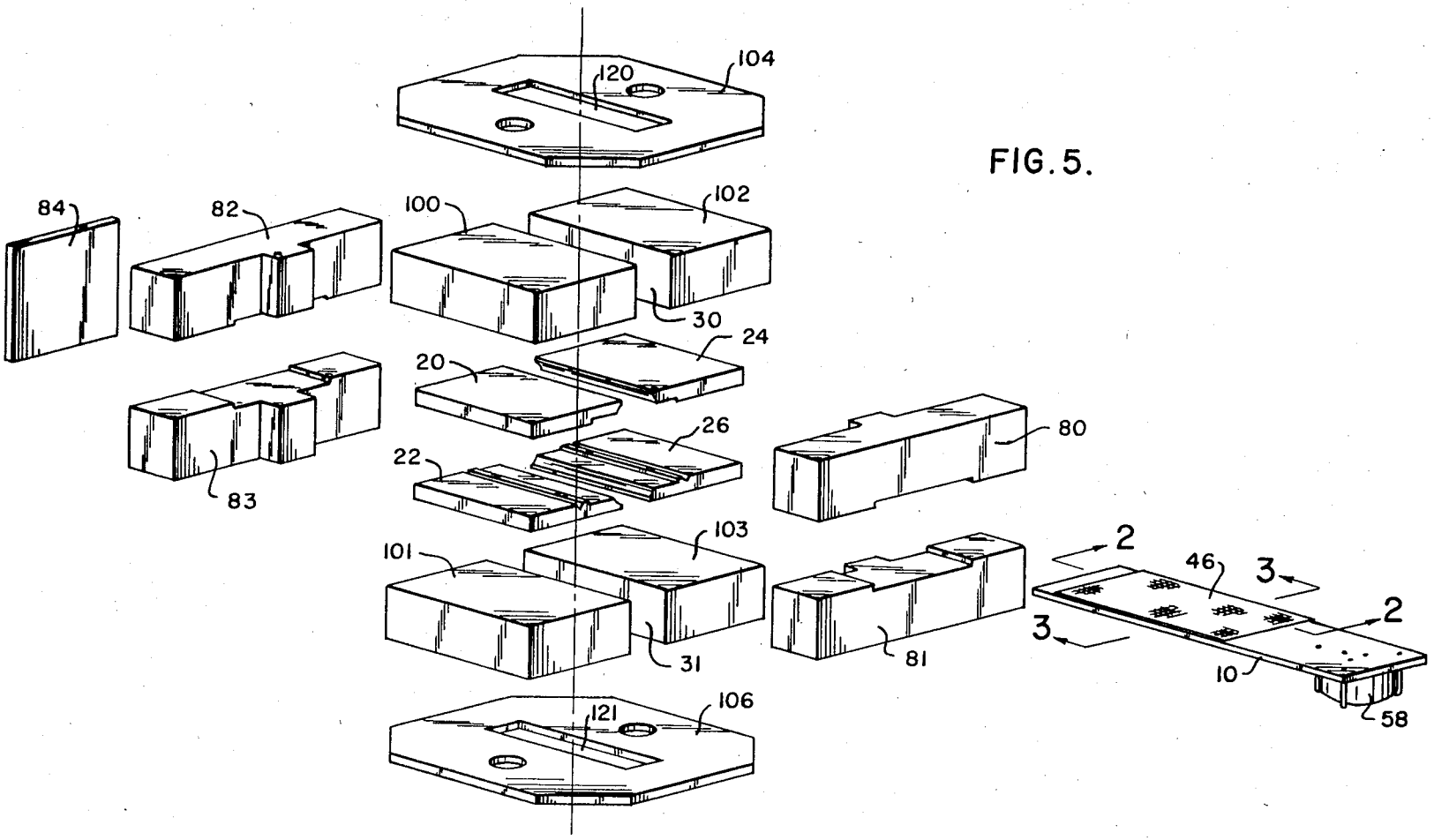
FIG. 5 is an exploded view of the ribbon loudspeaker magnet and wafer board assembly.

Spaces 30 and 31 between magnets 100 and 102 and 101 and 103, respectively, are fitted with end walls 80 and 82 and 81 and 83, respectively, as seen in FIG. 5 to form tunnels extending from gap 17 in either direction through the magnets 100 and 102 and 101 and 103 and return plates 104 and 106, respectively. Between end walls 80 and 81 and 82 and 83 is an aperture to permit the passage therethrough of the ribbon portion of a ribbon assembly. The assembly slides along tracks 18 until it contacts a stop plate 84 fitted over end walls 82 and 83 at which point the ribbon 16 is centrally positioned relative to tunnels formed between the magnets 100 and 102 and 101 and 103.

Prior to installing side rails 12 and 14 it is necessary to trim the elongated edges of the ribbon so that with the side rails in place there will be a uniform clearance between the side rails and the ribbon of less than 1.0% of the ribbon width. In order to accurately trim the ribbon edges an accurately machined carbon electrode (not shown) of a length substantially equal to that of the side rails is inserted through the wafer board 10 adjacent an elongated edge of the ribbon 16. A high negative voltage applied to the ribbon electrode relative to the ribbon results in a discharge which ablates and vapourizes the aluminum edge. The electrode is moved toward the ribbon until it contacts ears on one side of each mounting pad 50 and 51. The same process is repeated on the other side of the ribbon 16. By utilizing accurately machined side rails 12 and 14, in combination with an accurately machined carbon electrode, it is possible to position the side rail ribbon facing edges 13 and 15 adjacent the ribbon edges in essentially the relative position as was the carbon electrode when the latter contacted the ears of the mounting pads 50 and 52. Thus, the clearance created between the carbon electrode and the edge of the ribbon 16 by ablation of the ribbon edge is the same as the clearance between the side rail ribbon facing edges 13 and 15 and the ribbon 16. Uniform clearances as small as 0.0005 inches have been achieved in this way.

In operation when toroidal transformer 58 in response to an input signal on its primary windings provides an output signal across its secondary windings an electrical current is cause to flow along the ribbon transverse to the magnetic field across gap 17. The net force on the ribbon is perpendicular to board 10. As the ribbon current varies, the force on ribbon 16 varies and the latter vibrates producing sound vibrations in the air.

Other variations, modifications and departures lying within the spirit of the invention or scope as defined by the appended claims will be obvious to those skilled in the art.

I claim:

1. A ribbon assembly for use in a ribbon loudspeaker having an elongated electrically conducting ribbon, a magnet means for producing a magnetic field parallel to a mean plane through and directed transversely to said ribbon, and means for generating a varying electrical current through said ribbon, said ribbon assembly comprising:

(a) a wafer board having an elongated aperture;

(b) a pair of elongated side rails, one removably disposed along each elongated side of the aperture to form elongated ribbon facing edges of the aperture;

(c) electrically conducting pads at either end of said aperture; and, means for mounting said ribbon across the aperture to said electrically conducting pads at either end thereof such that the clearance between elongated edges of said ribbon and adjacent corresponding elongated ribbon facing edges of the aperture are less than 1% of an average width of said ribbon.

2. A ribbon assembly as defined by claim 1 wherein said side rails are magnetically permeable.

3. A ribbon assembly as defined by claim 1 wherein said wafer board is a printed circuit board having etched metal surfaces to provide electrically conducting paths thereon.

4. A ribbon assembly as defined by claim 1, wherein said ribbon is a metal foil and is welded to the pads at either end of said aperture.

* * * * *